US005913415A

United States Patent [19]

Kishi et al.

[11] Patent Number: 5,913,415

[45] Date of Patent: Jun. 22, 1999

[54] SWITCHING DEVICE

[75] Inventors: Shigenobu Kishi; Tatsushi Yonezawa, both of Kyoto, Japan

[73] Assignee: Omron Corporation, Kyoto, Japan

[21] Appl. No.: 08/950,914

[22] Filed: Oct. 15, 1997

[30] Foreign Application Priority Data

Oct. 15, 1996 [JP] Japan ..... 8-291209

[51] Int. Cl.[6] ..... H01H 13/36

[52] U.S. Cl. ..... 200/456

[58] Field of Search ..... 200/16 R–16 D, 200/402, 405, 407, 408, 424, 431, 433, 434, 435, 437–442, 449, 453–463, 467, 468

[56] References Cited

U.S. PATENT DOCUMENTS 4,045,632 8/1977 Pierrot ..... 200/67 PK
4,168,412 9/1979 Smith ..... 200/67 D
4,253,001 2/1981 Momozhane ..... 200/67 B
4,286,132 8/1981 Greenwald ..... 200/67 D
4,551,592 11/1985 Nishi et al. ..... 200/67 D
4,629,838 12/1986 Mironenko et al. ..... 200/67 D
4,764,649 8/1988 Sakai et al. ..... 200/67 D

*Primary Examiner*—Michael A. Friedhofer
*Attorney, Agent, or Firm*—Morrison & Foerster LLP

[57] ABSTRACT

A movable leaf having a movable contact is fixed to a common terminal, and a displacement absorber absorbing the displacement of the movable leaf is provided in the vicinity of the portion of the movable leaf connected to the common terminal. A lever member is attached to a case in a rotatable manner. A movable spring member is connected at one end to a free end of the lever member in a rotatable manner and is connected at the other end to the movable leaf. When an actuation plunger is depressed, a point of connection between the movable spring member and the lever member is moved beyond a point of joint between the movable leaf and the common terminal.

9 Claims, 14 Drawing Sheets

PRIOR ART

SWITCHING DEVICE

BACKGROUND OF THE INVENTION

1. Field of the Invention

The present invention relates to a switching device such as a microswitch having a snap-action function.

2. Description of the Related Art

As shown in FIG. 24, an existing switching device of this type comprises a case 60, a common terminal 61 attached to the case 60, and fixed terminals 62, 63 attached to the case 60. One end of a receiving member 64 is pivotably engaged with an engagement section 61*a* for the purpose of supporting the common terminal 61. A movable leaf retaining section 64*a* of the receiving member 64 pivotably supports a movable leaf 65. The common terminal 61 receives one end of a movable spring 66, and the other end of the movable spring 66 is engaged with a spring engagement section 65*a* of the movable leaf 65. The inner end of an actuation plunger 67 provided for the case 60 is brought into contact with a free end of the receiving member 64, and a cover (not shown) is fitted to the case 60.

Such a switching device has a snap-action function, so that a switching point is immediately reversed when the actuation plunger 67 is actuated to an operation position. The snap-action mechanism includes the receiving member 64 that is engaged at one end with the engagement section 61*a* of the common terminal 61, as previously described; the movable leaf 65 pivotably engaged with the movable leaf retaining section 64*a* of the receiving member 64; the movable spring 66 that is engaged at one end with the common terminal 61 and engaged at the other end with the spring engagement section 65*a* of the movable leaf 65; and the actuation plunger 67 whose inner end is brought into contact with a free end of the receiving member 64. As a result of the depression of the actuation plunger 67, a point of joint S between the movable leaf 65 and the receiving member 64 is moved beyond a point of joint R between the movable spring 66 and the common terminal 61.

In the foregoing existing switching device, in order to retain the snap-action characteristics of the switching device, the one end of the receiving member 64 is engaged with the engagement section 61*a* of the common terminal 61, and the movable leaf retaining section 64*a* of the receiving member 64 is pivotably engaged with and retains the movable leaf 65. The movable spring 66 is engaged at one end with the common terminal 61 and is engaged at the other end with the spring engagement section 65*a* of the movable leaf 65. In this way, the components are assembled into one device only through engagement.

When an electrical current flows through the engagement section between the components, heat develops in the engagement section as a result of constriction resistance. For this reason, the primary current-carrying section constructed by the common terminal 61, the receiving member 64, and the movable leaf 65 must be made of material having superior electrical conductivity, or the conductivity of the primary current-carrying section must be increased by plating, thereby adding to the cost. Further, if the engagement sections are fixed, the problem associated with conductivity will be solved. However, the reactive force caused by snap action reduces the lifetime of the components.

SUMMARY OF THE INVENTION

The present invention has been contrived in terms of the foregoing problem, and the object of the present invention is to provide a switching device which eliminates the need for forming the primary current-carrying section constructed by a common terminal and a movable member from a material having superior conductivity and for increasing the conductivity of the primary current-carrying section by plating; and which prevents the lifetime of components from being shortened and realizes cost cutting.

To this end, in accordance with a first aspect of the present invention, there is provided a switching device which brings the movable contact into or out of contact with a fixed contact by snap action, having: a movable member having the movable contact, the movable member being reversed by the snap action; and a common terminal fixed to the movable member by, e.g., caulking, welding, or screwing, wherein the movable member has a displacement absorber absorbing the displacement of a part of the movable member caused by the snap action.

With this configuration, although the snap action causes reactive force which acts on the portion of the movable member fixed to the common terminal, this reactive force is absorbed by the displacement absorber, and hence the snap action is prevented from being adversely affected by the fixation of the movable member to the common terminal.

As described above, the switching device having the snap-action function is allowed to be fixed to the common terminal of the movable member, thereby rendering it unnecessary to keep the good conductivity by the mutual engagement of components. As a result, the area of the switching device where heat develops because of constriction resistance can be reduced.

Consequently, it becomes unnecessary to form the primary current-carrying section consisting of the common terminal and the movable member from material having superior conductivity as well as unnecessary to plate the primary current-carrying section for the purpose of increasing the conductivity thereof, thereby resulting in cost cutting. Further, the lifetime of the components is prevented from being shortened.

To accomplish the foregoing object, in accordance with a second aspect of the present invention, there is provided the switching device as defined in the first aspect, further including: a lever provided in a rotatable manner; and a movable spring member which is connected at one end to a free end of the lever member in a rotatable manner and is connected at the other end to the movable member, wherein the snap action is performed when a point of connect between the movable spring member and the lever crosses a line which extends from a center of the movable contact to a point of joint between the movable member and the common terminal.

With this configuration, even if the movable member is fixed to the common terminal, the snap action is prevented from being adversely affected. Since the switching device having the snap-action function is allowed to be fixed to the common terminal of the movable member, it is unnecessary to keep the good conductivity by the mutual engagement of components, thereby enabling a reduction in the area of the switching device where heat develops because of constriction resistance.

Consequently, it becomes unnecessary to form the primary current-carrying section consisting of the common terminal and the movable member from material having superior conductivity as well as unnecessary to plate the primary current-carrying section for the purpose of increasing the conductivity thereof, thereby resulting in cost cutting.

The depression of the actuation plunger makes it possible to implement snap action by moving the point of connection Q between the movable member and the lever member beyond the point of joint R between the movable member and the common terminal, thereby enabling inversion of the position of the contact. As a result, the need for bringing a receiving member attached to the existing switching device into conduction is eliminated, resulting in a simple configuration.

To accomplish the foregoing object, in accordance with a third aspect of the present invention, in the switching device as defined in the first aspect, the movable member includes: a fixing section formed in a surface portion of a terminal main body via the displacement absorber; and side piece sections formed in the terminal main body, and further wherein the fixing section is fixed to the common terminal and each of the side piece sections has engagement section formed at the front end thereof; the engagement section being pivotably supported by the common terminal.

With this configuration, the switching device operates and yields advantageous results, as does the switching device in the first aspect. Although the snap action causes reactive force which acts on the fixing section of the movable member, the displacement absorber absorbs this reactive force. The movable member performs snap action on a fulcrum which is formed as a result of the meshing of the engagement sections of the side piece sections with an engagement recess.

Since the switching device having the snap-action function is allowed to be fixed to the common terminal of the movable member, it is unnecessary to keep the good conductivity by the mutual engagement of components, thereby enabling a reduction in the area of the switching device where heat develops because of constriction resistance.

Consequently, it becomes unnecessary to form the primary current-carrying section consisting of the common terminal and the movable member from material having superior conductivity as well as unnecessary to plate the primary current-carrying section for the purpose of increasing the conductivity thereof, thereby resulting in cost cutting.

To accomplish the foregoing object, in accordance with a fourth aspect of the present invention, in the switching device as defined in the third aspect, the displacement absorbing means is formed from a zigzag-shaped strap which is connected at one end to the terminal main body of the movable member and is connected at the other end to the fixing section.

With this configuration, the switching device operates and yields advantageous results, as does the switching device in the second aspect. The zigzag-shaped metal strip absorbs the reactive force developed in the fixing section of the movable member as a result of the snap action. The absorption of the reactive force can be accomplished in a more suitable manner.

To accomplish the foregoing object, in accordance with a fifth aspect of the present invention, in the switching device as defined in the third aspect, the displacement absorber is formed from a corrugated strap which is connected at one end to the terminal main body of the movable member and is connected at the other end to the fixing section.

With this configuration, the switching device operates and yields advantageous results, as does the switching device in the second aspect. The corrugated portion of the displacement absorber absorbs the reactive force developed in the fixing section of the movable member as a result of the snap action. The absorption of the reactive force can be accomplished in a more suitable manner.

To accomplish the foregoing object, in accordance with a sixth aspect of the present invention, in the switching device as defined in the second aspect, the movable member has spring characteristics.

With the configuration, when the actuation plunger is depressed, it becomes possible for the switching device to perform snap action by moving the point of connection Q where the movable spring member is connected to the lever member beyond the point of joint R where the movable member is joined to the common terminal, thereby reversing the position of the contact. At this time, the displacement of and loads on the spring caused by the snap action can be spread out over the movable member and the movable spring member.

As a result, the displacement of and the loads exerted on the movable spring member are reduced, and the lifetime of the overall components becomes longer. Further, even if the movable member is fixed to the common terminal, the snap action will be prevented from being adversely affected. Since the switching device having the snap-action function is allowed to be fixed to the common terminal of the movable member, it is unnecessary to keep the good conductivity by the mutual engagement of components, thereby enabling a reduction in the area of the switching device where heat develops because of constriction resistance.

Consequently, it becomes unnecessary to form the primary current-carrying section consisting of the common terminal and the movable member from material having superior conductivity as well as unnecessary to plate the primary current-carrying section for the purpose of increasing the conductivity thereof, thereby resulting in cost cutting.

DETAILED DESCRIPTION OF THE PREFERRED EMBODIMENTS

With reference to the accompanying drawings, embodiments of the present invention will be described.

FIRST EMBODIMENT

FIGS. 1 through 9 show a switching device in accordance with a first embodiment of the present invention.

Figure 1:
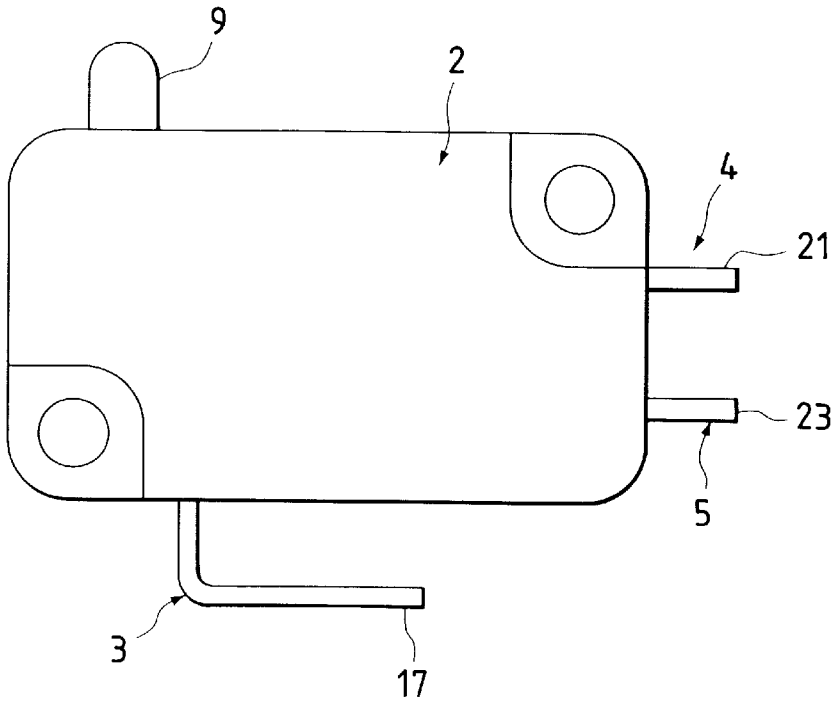
FIG. 1 is a front view showing a switching device in accordance with a first embodiment of the present invention.
Figure 2:
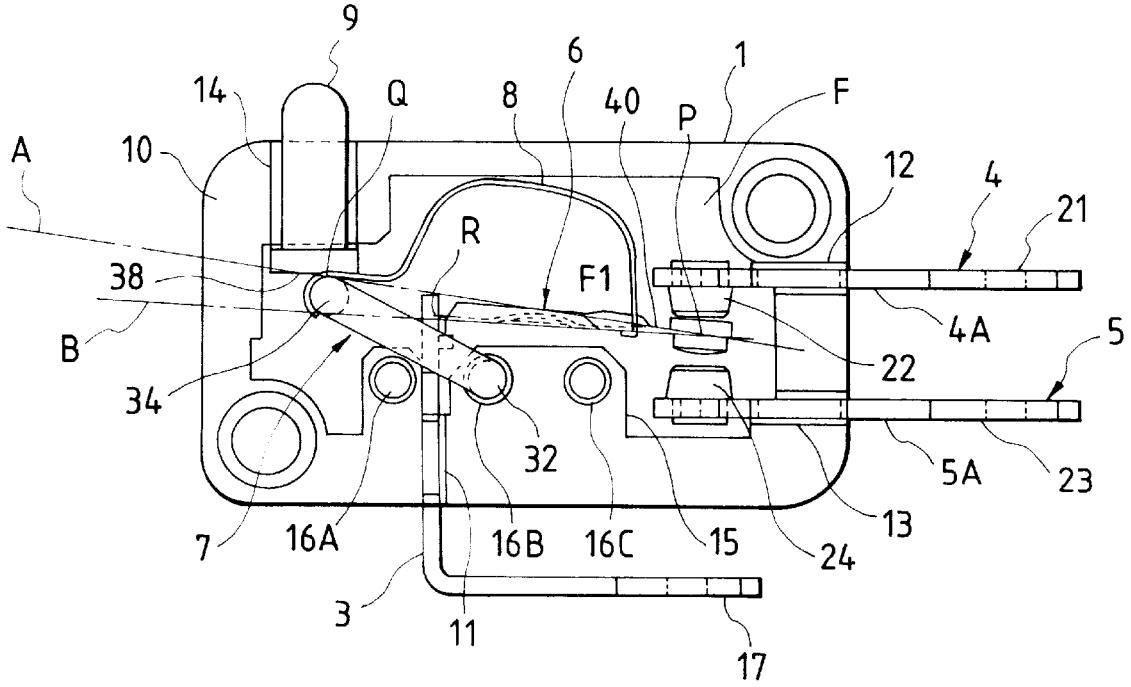
FIG. 2 is a front view showing the switching device while a cover is removed from the device.
Figure 3:
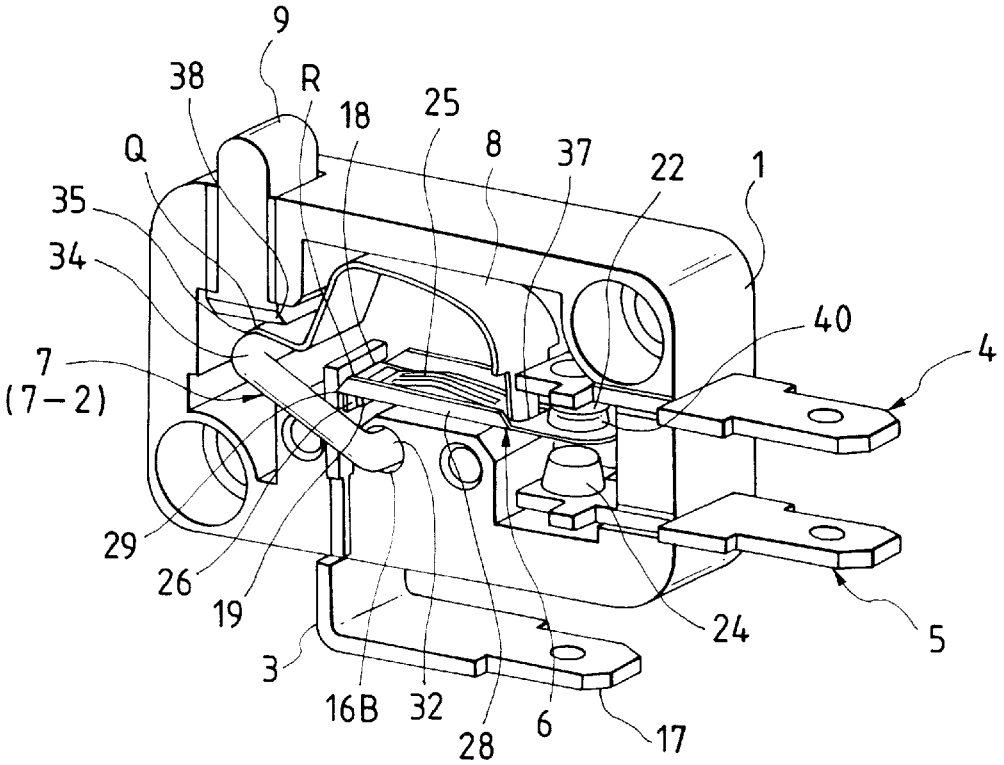
FIG. 3 is a perspective view showing the switching device while the cover is removed from the device.

FIG. 1 is a front view of a switching device (in accordance with the first embodiment) of the present invention; FIG. 2 is a front view showing the switching device while a cover is removed therefrom; and FIG. 3 is a perspective view showing the switching device.

A microswitch which is the switching device (in accordance with the first embodiment) of the present invention is generally constructed by a case 1, a cover 2, a common terminal 3, a first fixed terminal (a normally-closed fixed terminal) 4, a second fixed terminal (a normally-open fixed terminal) 5, a movable leaf 6 which is a movable member, a lever member 7, a movable spring 8 which is a movable spring member, and an actuation plunger 9.

Switching space F is ensured in the case 1. A common terminal insertion groove 11, fixed terminal insertion grooves 12, 13, and a plunger insertion groove 14 are formed in a mating section 10 where the case 1 is joined to the cover 2. A bulging section 15 is formed on the internal wall surface of the case 1 so as to be substantially opposite to the plunger insertion groove 14. Three lever support holes 16A, 16B, and 16C are formed at given intervals in the bulging section 15 in the longitudinal direction in FIG. 2.

Figure 4:
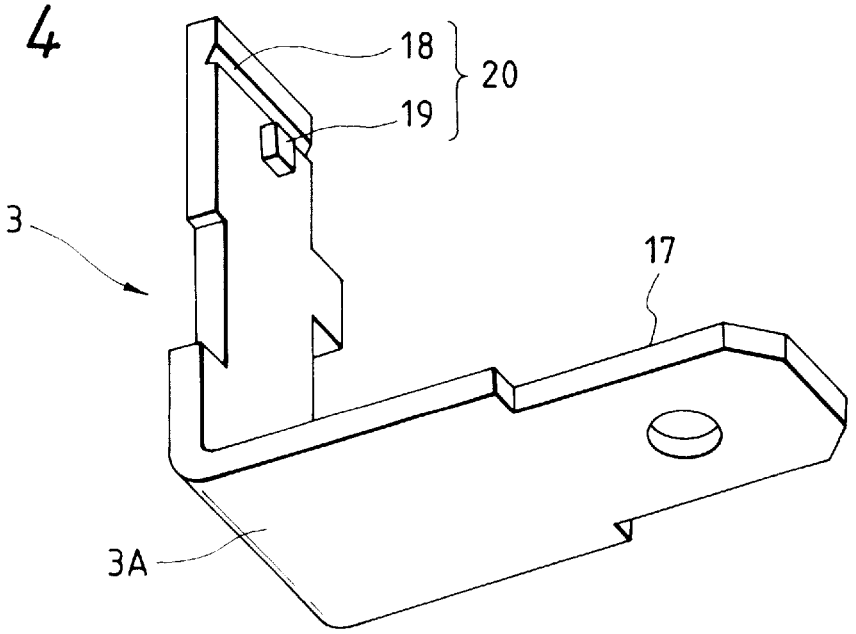
FIG. 4 is a perspective view showing a common terminal of the switching device.

As shown in FIG. 4, the common terminal 3 has a terminal main body 3A including a right-angled terminal leg 17. An engagement groove 18 having a V-shaped cross section is transversely formed in the front end of the terminal main body 3A, and a protuberance 19 is formed on the downside of the engagement groove 18. A movable spring retaining section 20 is formed by a combination of the engagement groove 18 and the protuberance 19.

The first fixed terminal 4 has a terminal main body 4A, and a terminal leaf 21*b* is formed on one end of the terminal main body 4A. A first fixed contact 22 is fixed to the other end of the terminal main body 4A. The second fixed terminal 5 has a terminal main body 5A, and a terminal leg 23 is formed on one end of the terminal main body 5A. A second fixed contact 24 is fixed to the other end of the terminal main body 5A.

Figure 5:
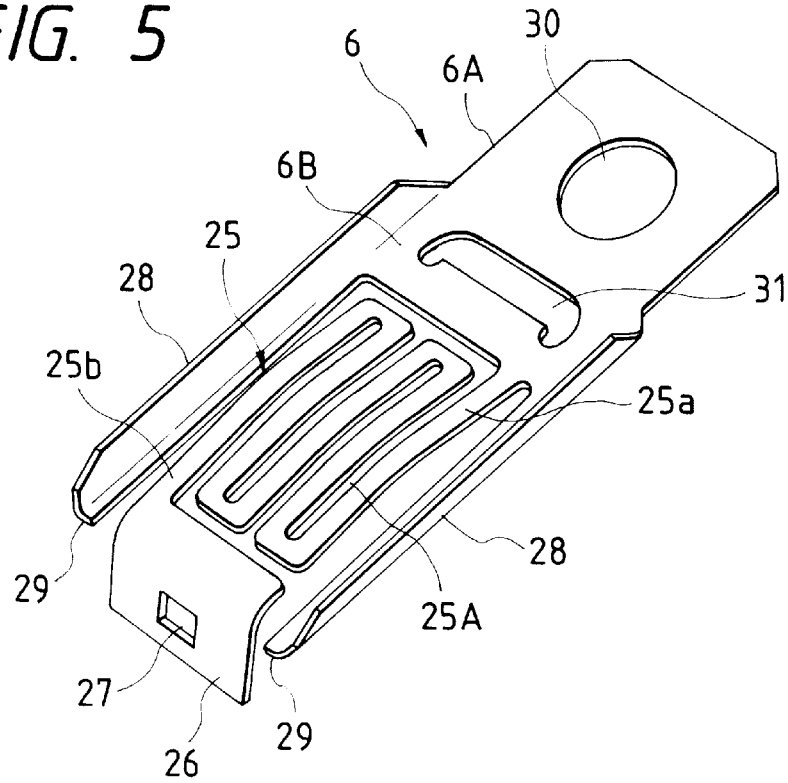
FIG. 5 is a perspective view showing a movable leaf of the switching device.

As shown in FIG. 5, the movable leaf 6 has a terminal main body 6A, and a fixing section 26 is formed in a surface 6B of the terminal main body 6A via a displacement absorbing section 25 which serves as displacement absorbing means. In short, the displacement absorbing section 25 is formed from a strap portion 25A punched the surface 6B into a zigzag pattern. The strap portion 25A of the displacement absorbing section 25 is connected at one end 25*a* to the surface 6B and is connected at the other end 25*b* to the fixing section 26. The fixing section 26 is angled at its middle portion so as to have a substantially L-shaped cross section. A hole 27 is formed in this fixing section 26.

As a result of the formation of the displacement absorbing section 25, a side piece section 28 having an L-shaped cross section is formed on each side of the displacement absorbing section 25 of the terminal main body 6A. An engagement section 29 is formed at the front end of each side piece section 28. A movable contact receiving hole 30 is formed in the front end of the terminal main body 6A, and a spring engagement hole 31 is formed between the receiving hole 30 and the displacement absorbing section 25. A movable contact 40 is fitted to the receiving hole 30.

Figure 6:
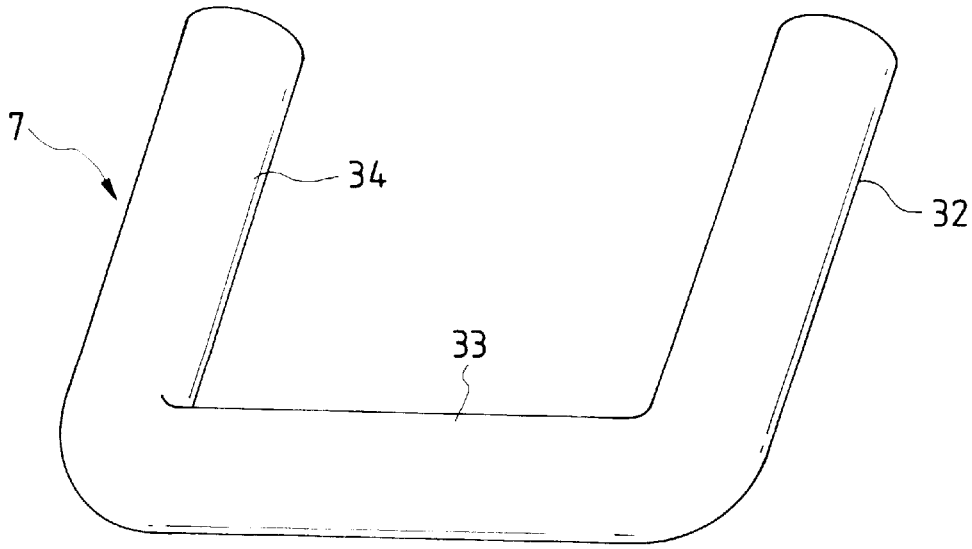
FIG. 6 is a perspective view showing a lever member of the switching device.

As shown in FIG. 6, the lever member 7 is formed by bending a rod material into a substantially C-shaped and has a joint section 33 which is connected at one end to a shaft support section 32 and is connected at the other end to a spring shaft section 34.

Figure 8:
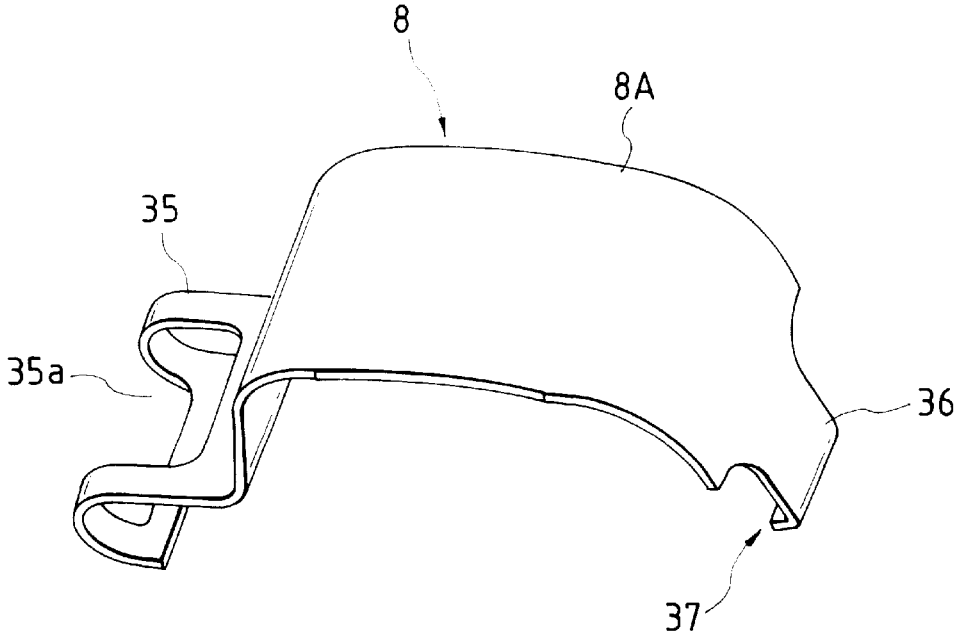
FIG. 8 is a perspective view showing a movable spring of the switching member.

As shown in FIG. 8, the movable spring 8 has a spring main body 8A made of a leaf spring material. The base portion of this spring main body 8A is bent into a substantial crank shape, and the end of the crank-shaped base portion is further bent so as to have a U-shaped cross section, thereby forming a hook 35 having a notch 35*a*. The front end of the spring main body 8A is curved, and the front end of the thus-curved portions is formed so as to have a narrow width. Further, the tip end of a narrow-width portion 36 is bent so as to form an engagement section 37.

Figure 7:
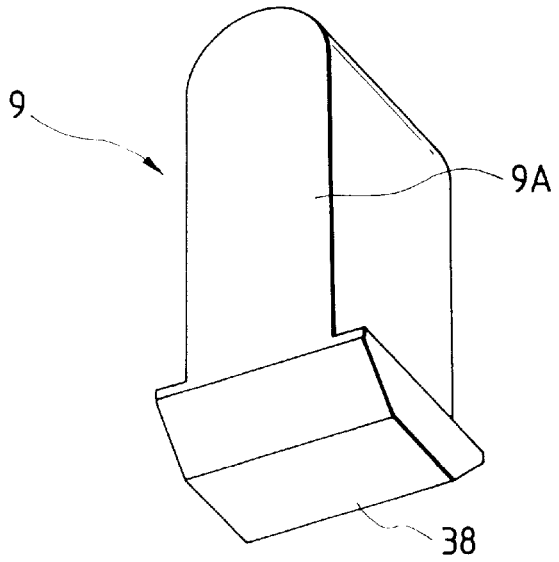
FIG. 7 is a perspective view showing an actuation plunger of the switching device.

As shown in FIG. 7, the actuation plunger 9 has a plunger main body 9A, and a pressing section 38 is formed at the front end of the plunger main body 9A.

The common terminal 3 and the first and second fixed terminals 4, 5 are fixed to the case 1, with the common terminal 3 being inserted into the common terminal insertion groove 11 and the first and second fixed terminals 4, 5 being inserted into the respective fixed terminal insertion grooves 12, 13. The terminal legs 17, 21, and 23 of the terminals 3, 4, and 5 project to the outside of the case 1, and the actuation plunger 9 is provided in the plunger insertion groove 14 of the case 1 so as to be slidable in the axial direction.

The movable leaf 6 is fixed to the common terminal 3 positioned in the switching space F by the movable spring retaining section 20. In short, the hole 27 of the fixing section 26 of the movable leaf 6 is fixed (or caulked or welded or the like) to the engagement protuberance 19, and the engagement sections 29 at the front ends of the side piece sections 28 are engaged with the engagement groove 18.

The lever member 7 is attached to the case 1 while the support section 32 is inserted into (or supported by) the lever support hole 16B in a rotatable manner. Further, the hook 35 of the movable spring 8 is engaged with the spring shaft section 34 of the lever member 7, and the engagement section 37 of the movable spring 8 is engaged with the spring engagement hole 31 of the movable leaf 6.

The movable contact 40 provided at the front end of the movable leaf 6 is positioned between the first and second fixed contacts 22, 24 of the first and second fixed terminals 4, 5. As shown in FIGS. 2 and 3, the movable contact 40 is in contact with the first fixed contact 22, and the pressing section 38 of the actuation plunger 9 is in contact with the spring shaft section 34 of the lever member 7.

The operation of the switching device having the foregoing configuration will now be described.

In FIG. 2, the symbol A designates a line of action of force which is provided between a center point P of the movable contact 40 and a point of contact Q where the movable spring 8 is joined to the lever member. The symbol B designates a line of action of force which is provided between the center point P of the movable contact 40 and a point R where the engagement section 29 of the movable leaf 6 is engaged with the engagement groove 18 (or a point where the movable leaf 6 is joined to the common terminal 3). As shown in this figure, in a state in which the movable contact 40 provided on the movable leaf 6 is in contact with the first fixed contact 22 of the first fixed terminal 4, the line of action of force A is positioned closer to the actuation plunger 9 in comparison with the line of action of force B. Force F1 caused by the movable spring 8 acts in an upper left direction in FIG. 2 along the line A, thereby holding the movable contact 40 in contact with the first fixed contact 22.

When the actuation plunger 9 is pressed down, the pressing section 38 of the actuation plunger 9 presses down the spring shaft section 34 of the lever member 7. As a result, the lever member 7 pivots in a counterclockwise direction in FIG. 2 about the shaft support section 32. When the contact point Q goes beyond the point of joint R in a downward direction as a result of the rotation of the lever member 7, the direction in which the force F1 produced by the movable spring 8 acts is reversed. As a result, the movable leaf 6 performs snap action, and the movable contact 40 is disengaged from the first fixed contact 22 and comes into contact with the second fixed contact 24.

More specifically, since the line of action of force A goes beyond the line of action of force B in a downward direction, the force F1 produced by the movable spring 8 acts in a lower left direction in FIG. 2 along the line A. As a result, the movable contact 40 comes into contact with the second fixed contact 24. The force F1 appears as a reactive force on the area where the movable leaf 6 is engaged with the common terminal 3, i.e., on the point of joint R and on the area where the movable contact 40 and the first fixed contact 22 are in contact with each other. However, the force F1 does not appear on the fixed (or caulked) portion of the fixing section 26. This is attributable to the fact that the displacement absorbing section 25 absorbs displacement, and that the movement of the movable leaf 6 does not affect the fixing section 26.

In the reversing operation, the lever member 7 is reversely rotated by the force of the movable spring 8, thereby returning the actuation plunger 9 to its original position.

Figure 9:
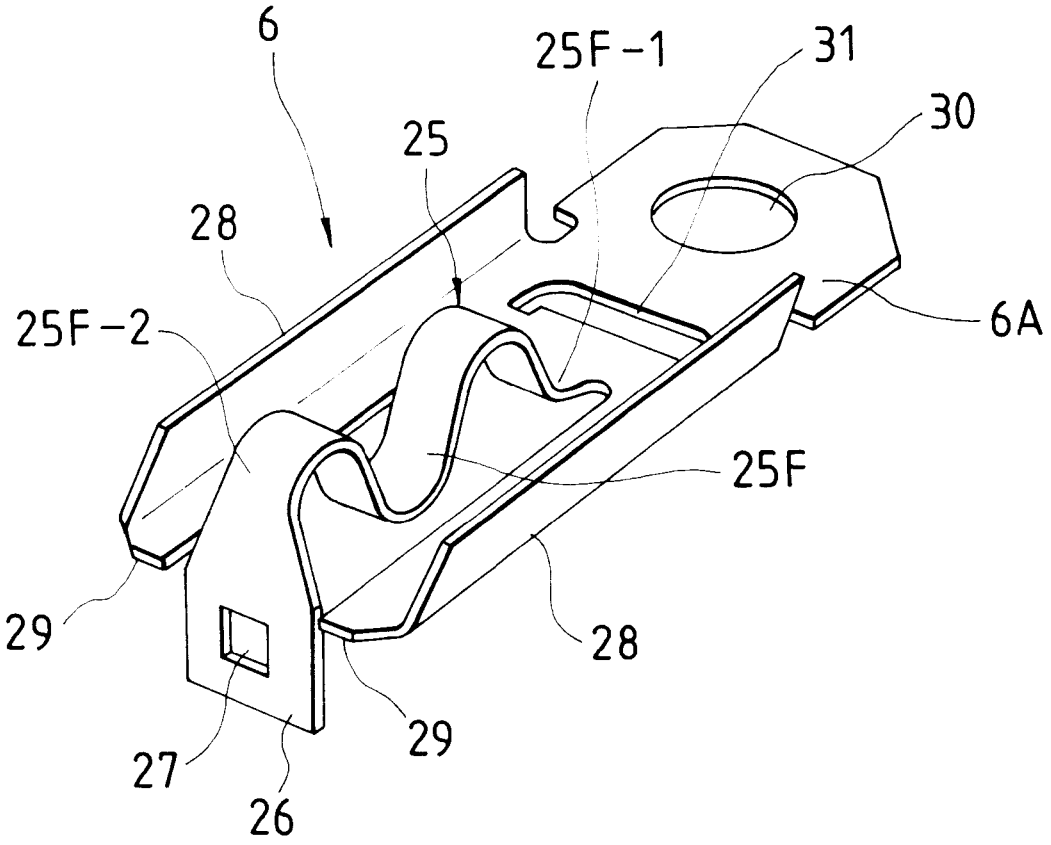
FIG. 9 is a perspective view showing another embodiment of the movable leaf.

As shown in FIG. 5, the displacement absorbing section 25 is formed in the movable leaf 6 by punching the surface 6B of the terminal main body 6A into a zigzag pattern. The shape of the displacement absorbing section 25 is not limited to this zigzag pattern. As shown in FIG. 9, the displacement absorbing section 25 may be formed by corrugating a plate 25F. In this case, one end 25F-1 of the corrugated plate 25F is connected to the terminal main body 6A of the movable leaf 6, and an another end 25F-2 of the corrugated plate 25F is connected to the fixing section 26.

In the switching device having the foregoing configuration, the lever member 7 is exchanged in the following manner. For example, the cover 2 is removed from the case 1, and the support shaft section 32 of a second lever member 7-2 is removed from a second lever support hole 16B, and the spring shaft section 34 thereof is disengaged from the hook 35 of the movable spring 8. The second lever member 7-2 is finally removed from the case 2. Another differently-sized first lever member 7-1 (or a third lever member 7-3) is inserted into a first lever support hole 16A (or a third lever support hole 16C), and the spring shaft 34 is engaged with the hook 35 of the movable spring 8. The device is then fitted into the case 1, and the case 1 is further covered with the cover 2.

Figure 10A:
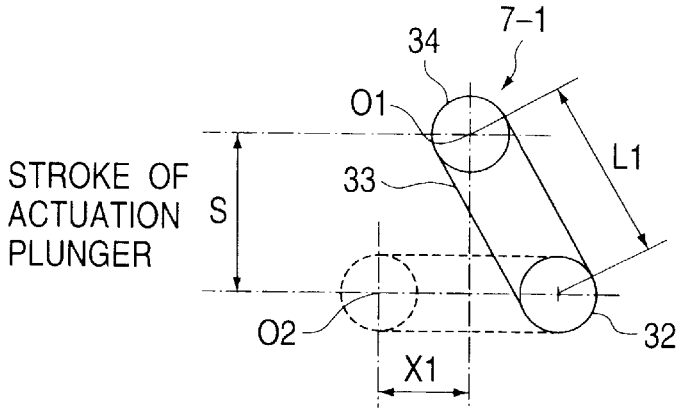
FIGS. 10A to 10C are diagrammatic representations showing the amount of stroke of the respective different-sized lever members.
Figure 10B:
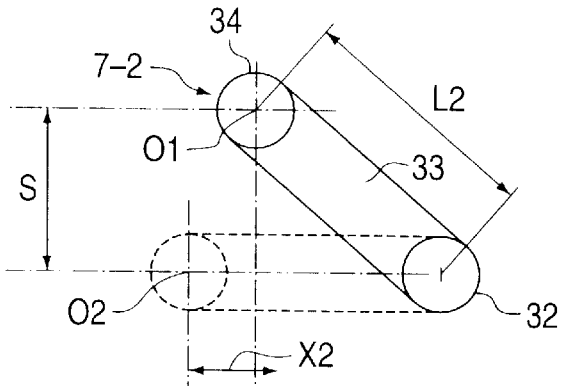
Figure 10C:
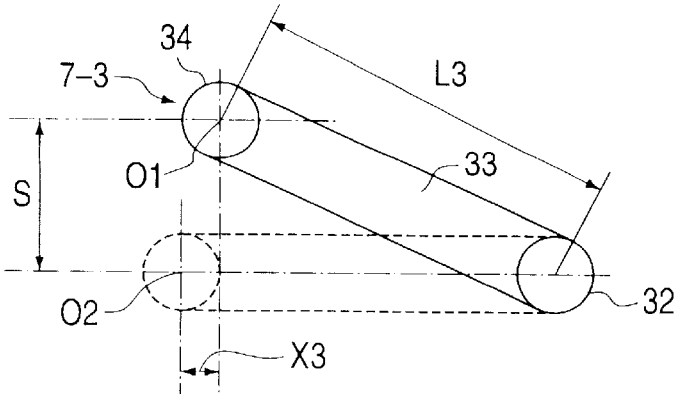

As shown in FIGS. 10A to 10C, a dimension between the shaft support section 32 and the spring shaft section 34, that is, an inter-shaft dimension, is L1 which is shorter than an inter-shaft dimension L2 of the second lever member 7-2. A dimension between the support shaft section 32 and the spring shaft section 34 of the third lever member 7-3, that is an inter-shaft dimension, is L3 which is shorter than the inter-shaft dimension L2 of the second lever member 7-2.

The center of the spring shaft section 34 positioned before it is pressed (i.e., the center of the spring shaft section 34 positioned at the starting point of an actuation plunger stroke S) is taken as O1. The center of the spring shaft section 34 positioned after the lever member 7 has been pivoted about the support shaft section 32 to thereby cause the movable leaf 6 to perform snap action and the movable contact 40 has come into contact with the second fixed contact 24 (i.e., the center of the spring shaft section 34 positioned at the end point of the actuation plunger stroke S) is taken as O2. The horizontal distance between the centers O1 and O2 of the spring shaft section 34 is taken as X1 with regard to the first lever member 7-1, X2 with regard to the second lever member 7-2, and X3 with regard to the third lever member 7-3, respectively. The relationship between the distances X1, X2, and X3 is defined as $$X1>X2>X3.$$

As the distance X1, X2, or X3 increases, the extent of expansion of the movable spring 8 is also increased, thereby resulting in an increase in the load required for actuation (or the load exerted on the actuation plunger).

Accordingly, the actuation load can be changed by solely exchanging the lever member to any one of the first, second, and third lever members 7-1, 7-2, and 7-3 having different sizes (i.e., the dimensions L1, L2, and L3).

In accordance with the first embodiment, in a case where the movable leaf 6 causes snap action, reactive force develops in the fixing section 26 of the movable leaf 6. This reactive force is absorbed by the displacement absorbing section 25. The movable leaf 6 performs snap action by treating an engagement portion of the engagement sections 29 of the side piece sections 28 with the engagement recess 18 as a fulcrum.

Consequently, in the switching device having the snap action function, the movable leaf 6 can be fixed to the common terminal 3, thereby rendering it unnecessary to keep the good conductivity by the mutual engagement of components, and rendering it possible to reduce the area where heat develops as a result of constriction resistance.

Accordingly, it becomes unnecessary to form the primary current-carrying section constructed by the common terminal 3 and the movable leaf 6 from material having superior conductivity as well as unnecessary to plate the primary current-carrying section for the purpose of increasing the conductivity thereof, thereby resulting in cost cutting.

SECOND EMBODIMENT

FIGS. 11 through 15 show a switching device in accordance with a second embodiment of the present invention.

Figure 11:
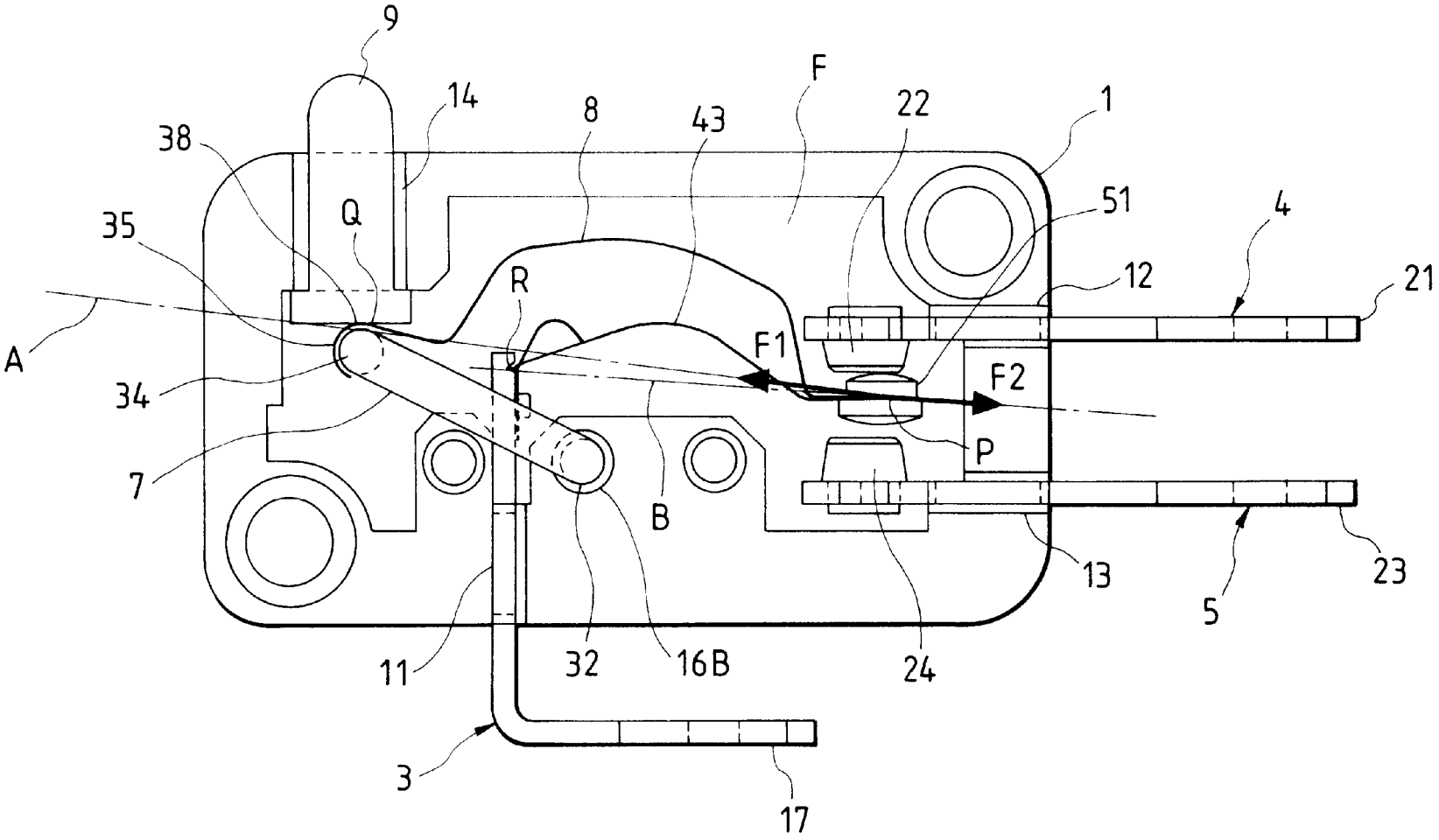
FIG. 11 is a front view showing a switching device in accordance with a second embodiment of the present invention.
Figure 12:
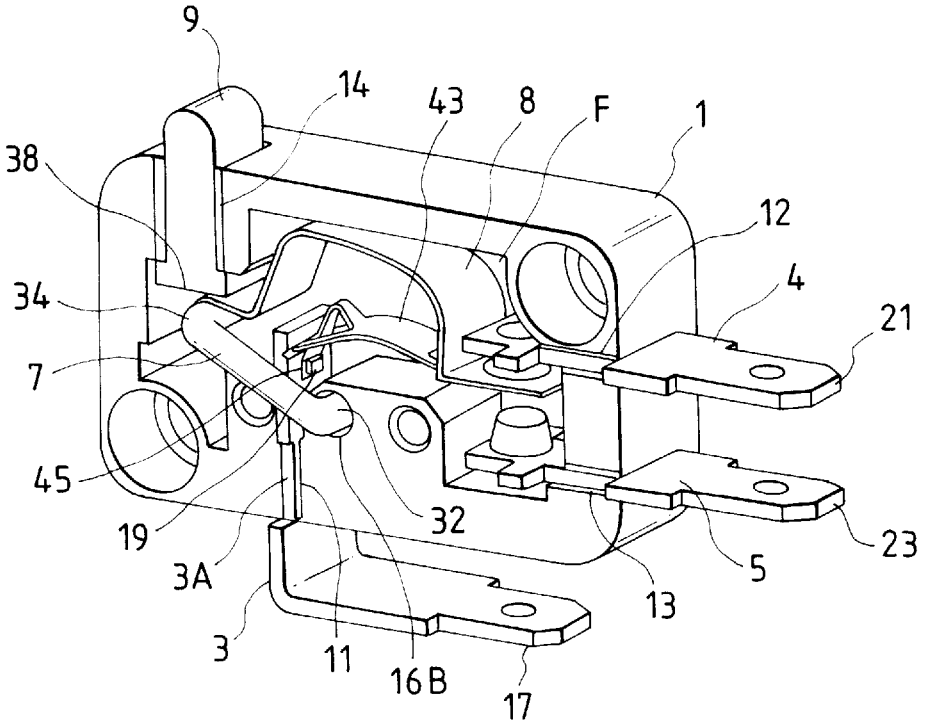
FIG. 12 is a perspective view showing the switching device while a cover is removed therefrom.

FIG. 11 is a front view showing a switching device (in accordance with the second embodiment) of the present invention while a cover is removed therefrom; and FIG. 12 is a perspective view showing the switching device.

A microswitch which is the switching device (in accordance with the second embodiment) of the present invention is different solely in the configuration of the movable leaf from the switching device in accordance with the first embodiment. In other respects, these switching devices are identical with each other, and therefore the components which are the same as those used in the first embodiment are assigned the same reference numerals.

Figure 13:
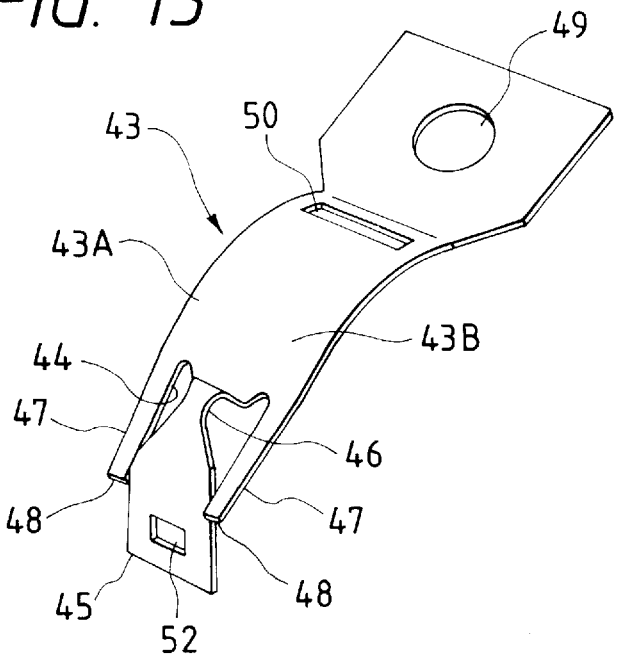
FIG. 13 is a perspective view showing a movable leaf of the switching device.
Figure 14:
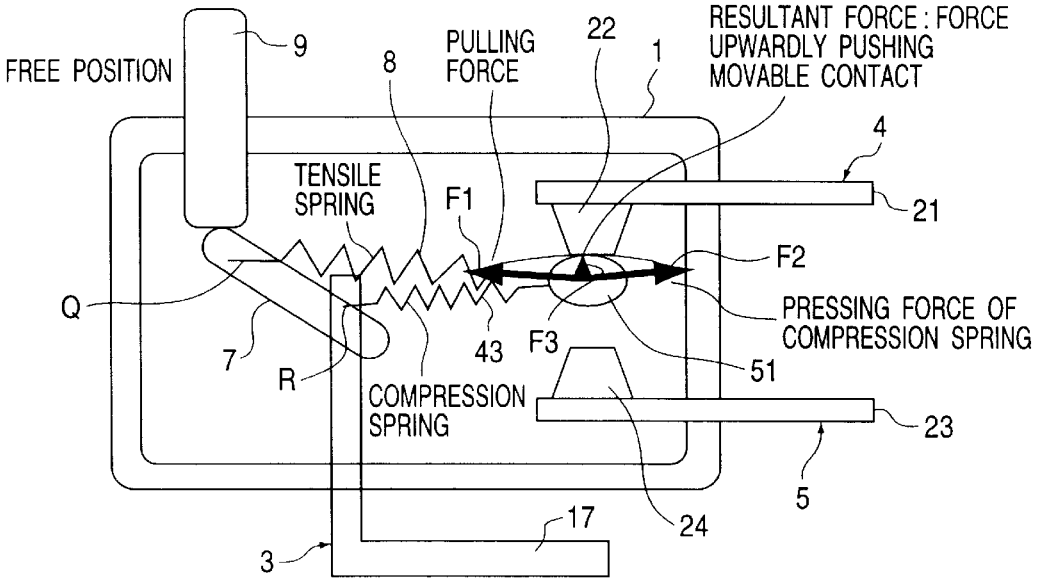
FIG. 14 is a diagrammatic representation showing the action of force of the movable leaf at a free position in the switching device.

As shown in FIG. 13, a movable leaf 43 of the microswitch in accordance with the second embodiment has a terminal main body 43A possessing the spring characteristics, and a fixing section 45 is formed in a surface 43B of the terminal main body 43A via a displacement absorbing section 44. In short, the displacement absorbing section 44 is formed by punching the surface 43B into a strap-shaped form having a constriction 46. The displacement absorbing section 44 is connected at one end to the surface 43B and is connected at the other end to the fixing section 45. This displacement absorbing section 44 is bent at its middle point into an substantially L-shaped form. An engagement hole 46 is formed in this fixing section 52.

As a result of the formation of the displacement absorbing section 44, a side piece section 47 is formed on each side of the displacement absorbing section 44 of the terminal main body 43A. An engagement section 48 is formed at the front end of each side piece section 47. A movable contact receiving hole 49 is formed in the front end of the terminal main body 43A, and a spring engagement hole 50 is formed between the movable contact receiving hole 49 and the displacement absorbing section 44. A movable contact 51 is fitted to the moveable contact receiving hole 49.

The common terminal 3 and the first and second fixed terminals 4, 5 are fixed to the case 1, with the common terminal 3 being inserted into the common terminal insertion groove 11 and the first and second fixed terminals 4, 5 being inserted into the respective fixed terminal insertion grooves 12, 13. The terminal legs 17, 21, and 23 of the terminals 3, 4, and 5 project to the outside of the case 1, and the actuation plunger 9 is provided in the plunger insertion groove 14 of the case 1 so as to be slidable in the axial direction.

The movable leaf 6 is fixed to the common terminal 3 positioned in the switching space F by the movable spring retaining section 20. In short, the hole 27 of the fixing section 26 of the movable leaf 6 is fixed (or caulked or welded or the like) to the engagement protuberance 19, and the engagement sections 29 at the front ends of the side piece sections 28 are engaged with the engagement groove 18.

The lever member 7 is attached to the case 1 while the support section 32 is inserted into (or supported by) the lever support hole 16B in a rotatable manner. Further, the hook 35 of the movable spring 8 is engaged with the spring shaft section 34 of the lever member 7, and the engagement section 37 of the movable spring 8 is engaged with an spring engagement hole 50 of the movable leaf 43.

The movable contact 51 provided at the front end of the movable leaf 43 is positioned between the first and second fixed contacts 22, 24 of the first and second fixed terminals 4, 5. As shown in FIG. 11, a movable contact 51 is in contact with the first fixed contact 22, and the pressing section 38 of the actuation plunger 9 is in contact with the spring shaft section 34 of the lever member 7.

In the second embodiment, the movable leaf 43 has the spring characteristics. While being assembled into the switching device in the manner as previously described, the movable leaf 43 acts as a compression spring and the movable spring 8 acts as a tensile spring.

The operation of the switching device having the foregoing configuration will now be described.

In FIG. 2, the symbol A designates a line of action of force which is provided between a center point P of the movable contact 40 and a point of contact Q where the movable spring 8 is joined to the lever member. The symbol B designates a line of action of force which is provided between the center point P of the movable contact 40 and a point R where the engagement section 29 of the movable leaf 6 is engaged with the engagement groove 18 (or a point where the movable leaf 6 is joined to the common terminal 3). As shown in this figure, in a state in which the movable contact 40 provided on the movable leaf 6 is in contact with the first fixed contact 22 of the first fixed terminal 4, the line of action of force A is positioned closer to the actuation plunger 9 in comparison with the line of action of force B. Force F1 caused by the movable spring 8 acts in an upper left direction in FIG. 2 along the line A, thereby holding the movable contact 40 in contact with the first fixed contact 22.

When the actuation plunger 9 is pressed down, the pressing section 38 of the actuation plunger 9 presses down the spring shaft section 34 of the lever member 7. As a result, the lever member 7 pivots in a counterclockwise direction in FIG. 11 about the shaft support section 32. When the contact point Q goes beyond the point of joint R in a downward direction as a result of the rotation of the lever member 7, the movable leaf 43 performs snap action. The movable contact 40 is disengaged from the first fixed contact 22 and comes into contact with the second fixed contact 24.

Figure 15:
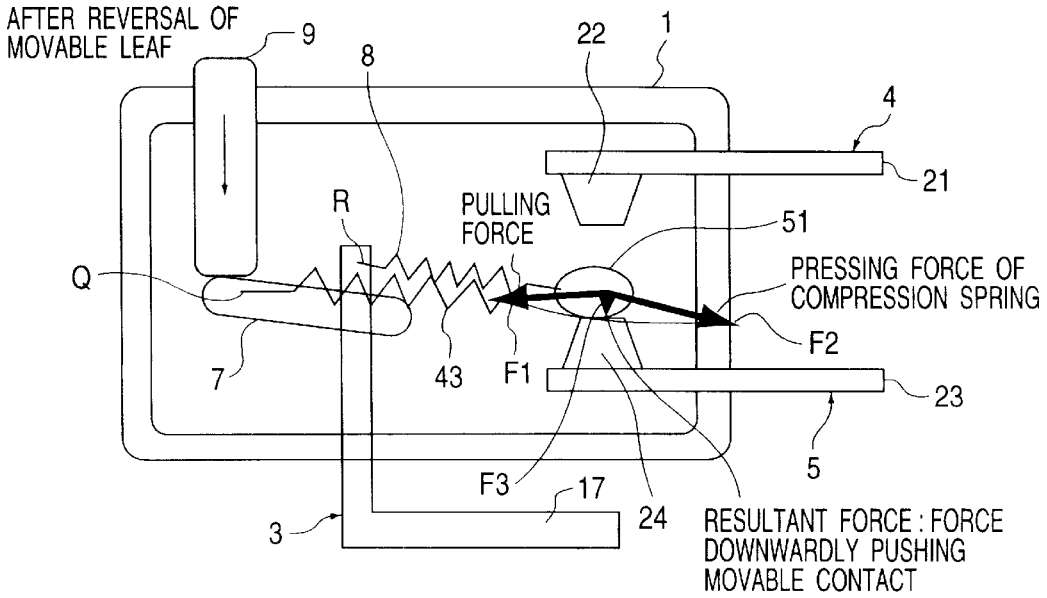
FIG. 15 is a diagrammatic representation showing the action of force of the movable leaf at a reversed position in the switching device.

More specifically, since the line of action of force A goes beyond the line of action of force B in a downward direction, the force F1 produced by the movable spring 8 acts in the left direction in FIG. 15 along the line A. The force F2 produced by the movable leaf 43 acts in the right direction in FIG. 15 along the line B. The resultant force F3 which is the sum of the forces F1 and F2 develops in a downward direction, thereby bringing the movable contact 51 into contact with the second fixed contact 24.

In reversing action, the lever member 7 is reversely rotated by the force of the movable spring 8, thereby returning the actuation plunger 9 to its original position.

In accordance with the second embodiment, in a case where the movable leaf 43 causes snap action, reactive force develops in the fixing section 45 of the movable leaf 43. This reactive force is absorbed by the displacement absorbing section 44. The movable leaf 43 performs snap action by treating the engagement of the engagement sections 48 of the side piece sections 47 with the engagement recess 18 as fulcrum. More specifically, as a result of depression of the actuation plunger 9, the point of connection Q where the movable spring 8 is joined to the lever member 7 goes beyond the point of joint R where the movable leaf 43 is joined to the common terminal 3, thereby reversing the position of the contact. At this time, the displacement of and loads on the spring caused by the snap action can be spread out over the movable leaf 43 and the movable spring 8.

As a result, the displacement of and the loads exerted on the movable spring 8 are reduced, thereby resulting in a decrease in the amount of displacement of the movable spring 8. Consequently, the lifetime of the overall components becomes longer. Further, even if the movable leaf 43 is fixed to the common terminal 3, the snap action will be prevented from being adversely affected. Since the switching device having the snap-action function is allowed to be fixed to the common terminal 3 of the movable member 43, it is unnecessary to keep the good conductivity by the mutual engagement of components, thereby enabling a reduction in the area of the switching device where heat develops because of constriction resistance.

Accordingly, it becomes unnecessary to form the primary current-carrying section consisting of the common terminal 3 and the movable leaf 43 from material having superior conductivity as well as unnecessary to plate the primary current-carrying section for the purpose of increasing the conductivity thereof, thereby resulting in cost cutting.

THIRD EMBODIMENT

FIGS. 16 through 21 show a switching device in accordance with a third embodiment of the present invention.

Figure 16:
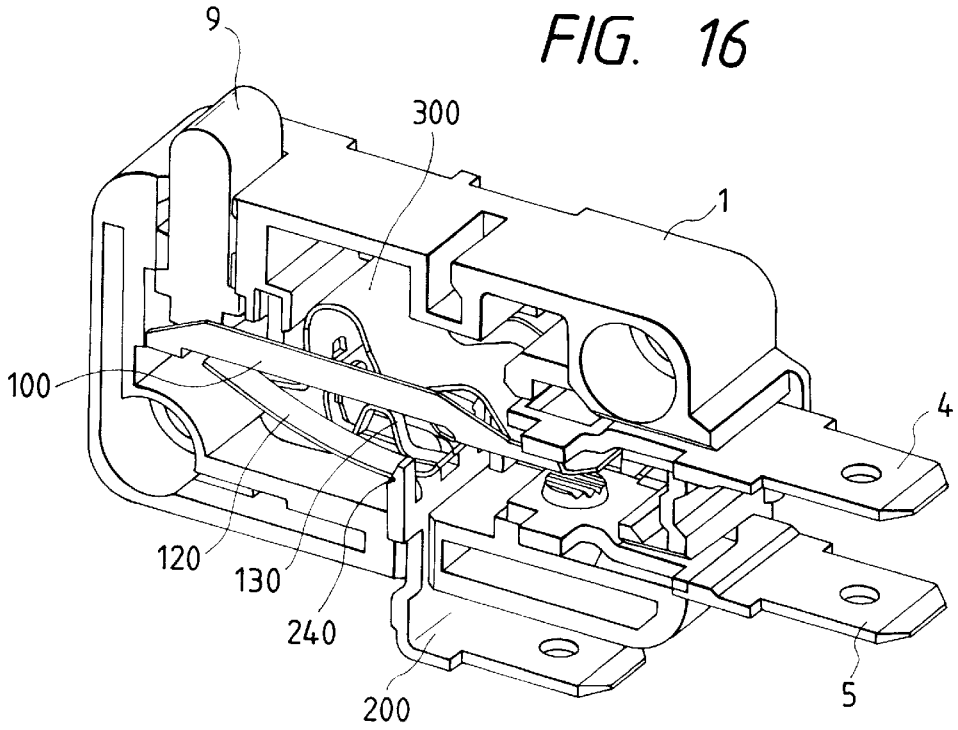
FIG. 16 is a perspective view showing a switching device in accordance with a third embodiment of the present invention while a cover is removed therefrom.
Figure 17:
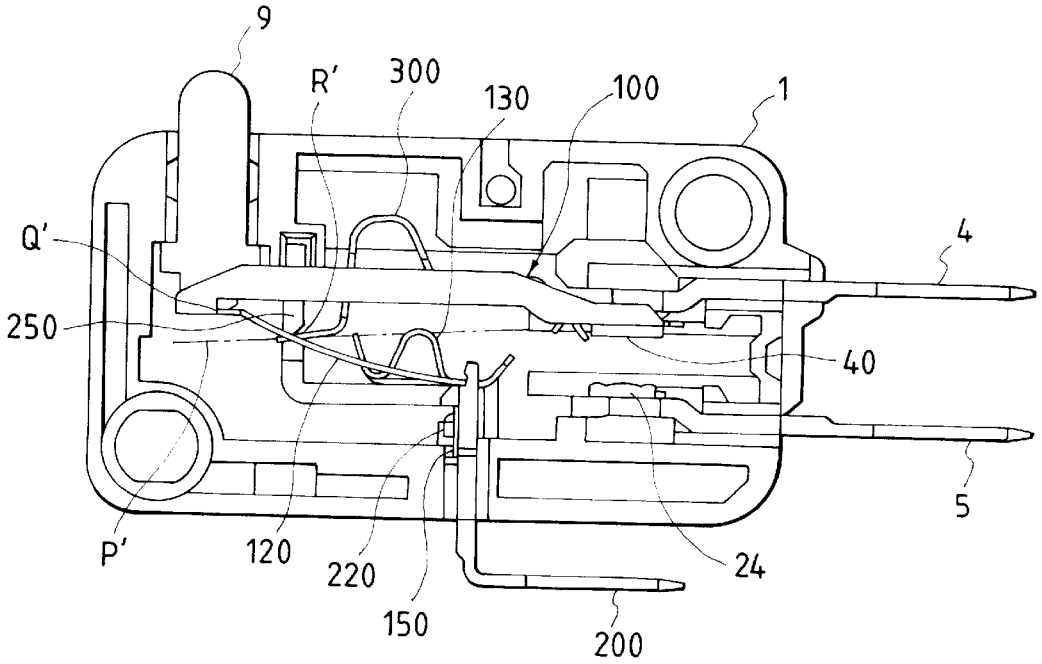
FIG. 17 is a front view showing the switching device while the cover is removed therefrom.

FIG. 16 is a perspective view showing a switching device in accordance with the third embodiment while a cover is removed therefrom; and FIG. 17 is a front view showing the switching device. A microswitch in accordance with the third embodiment is different in the configuration of the movable leaf, the common terminal and the movable spring from the switching devices in accordance with the other embodiments. In other respects, these switching devices are identical with each other, and therefore the components which are the same as those used in the previous embodiments are assigned the same reference numerals.

First, the configuration of each component will be described.

Figure 18:
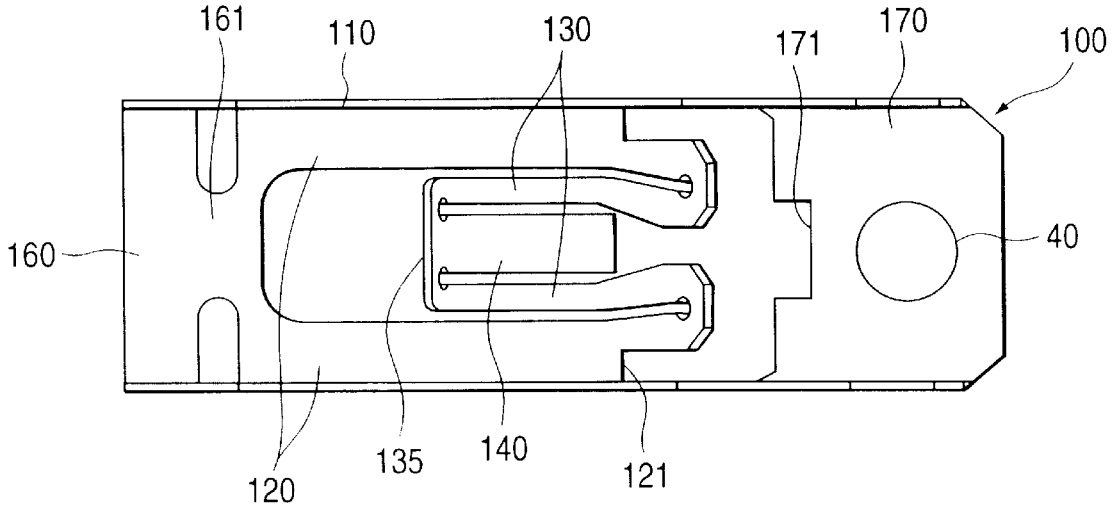
FIG. 18 is a plan view showing a movable leaf of the switching device.
Figure 19:
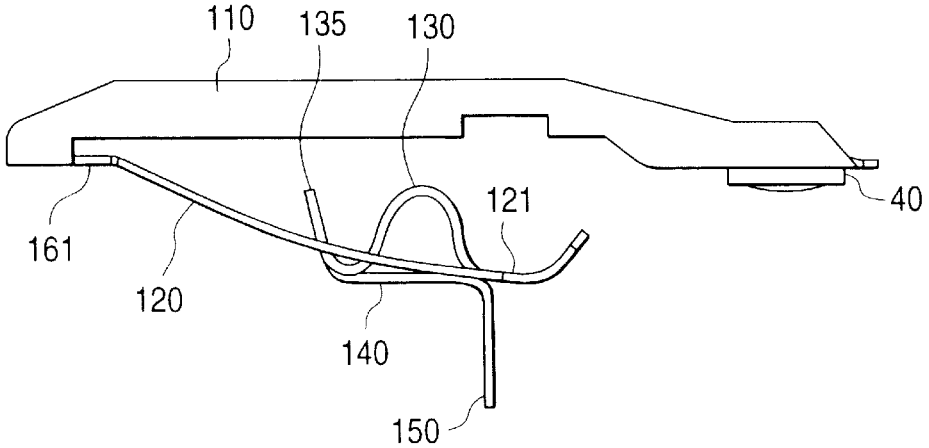
FIG. 19 is a front view showing the movable leaf of the switching device.
Figure 20:
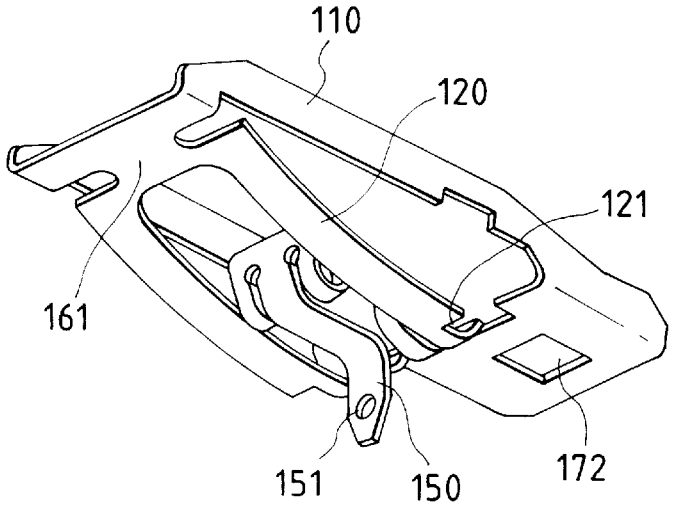
FIG. 20 is a perspective view showing the movable leaf of the switching device.

As shown in FIGS. 18 through 20, a movable leaf 100 in accordance with a third embodiment has side piece sections 110, lever arm sections 120, a displacement absorbing section 130, a fixing section 150, a plunger contact section 160, and a mount surface 170 to which the movable contact 40 is attached. The movable leaf 100 is formed from one metal plate. Each of the two lever arms 120 is joined at one end to an actuation plunger contact section 160 via a respective constriction 161. Each of these lever arms 120 is joined at the other end to the displacement absorbing section 130. The lever arms 120 and the displacement absorbing section 130 are punched into a zigzag pattern. The displacement absorbing section 130 is not only zigzagged but also curved into an S-shaped form in a thicknesswise direction of the movable leaf 100.

The displacement absorbing section 130 is joined to the fixing section 150, and a hole 151 to be connected to a common terminal 200 is formed in the fixing section 150.

Figure 21:
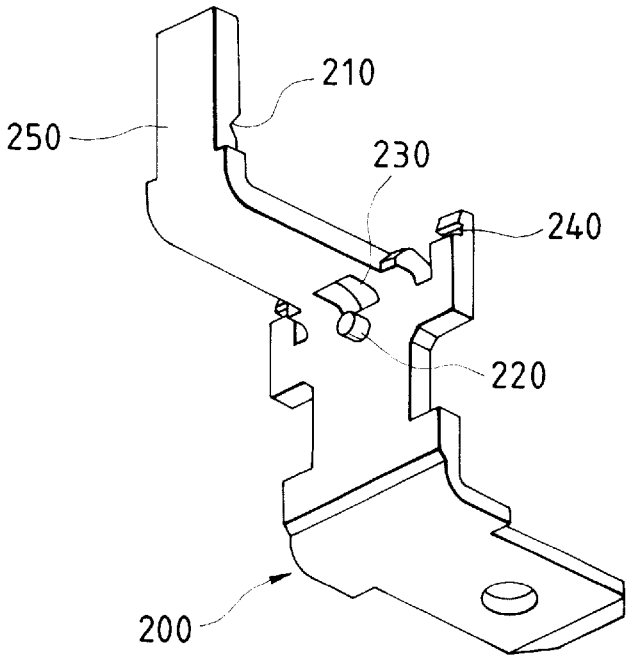
FIG. 21 is a perspective view showing the movable leaf of the switching device.

FIG. 21 is a perspective view showing the common terminal in accordance with the third embodiment. This common terminal 200 is also made from a metal plate and has an engagement groove 210, a protuberance 220, a hole 230, and a support groove 240.

Figure 22:
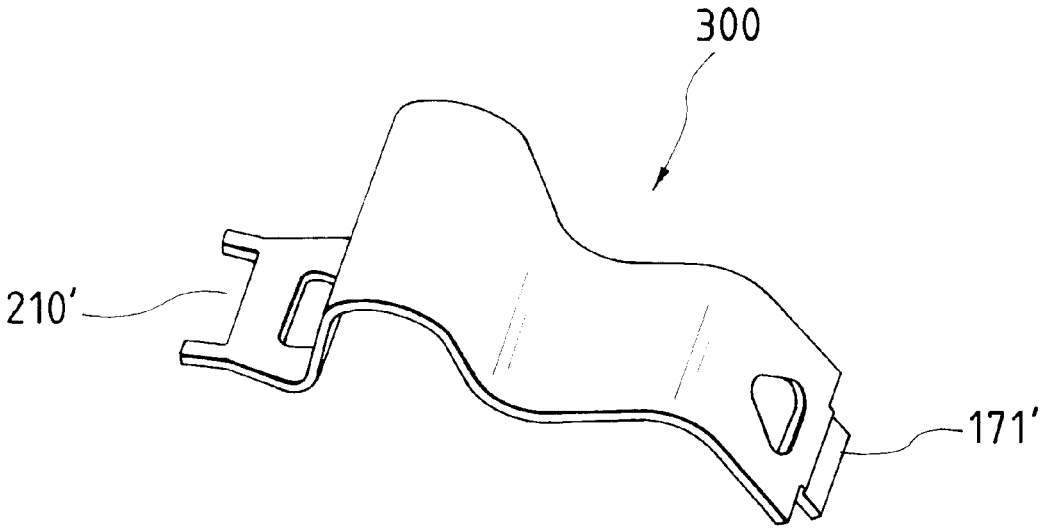
FIG. 22 is a perspective view showing a movable spring of the switching device.
Figure 23:
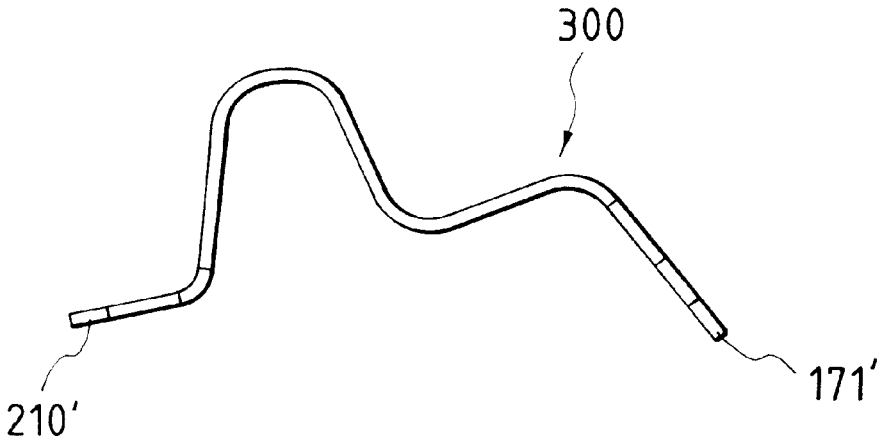
FIG. 23 is a front view showing the movable spring of the switching device.
Figure 24:
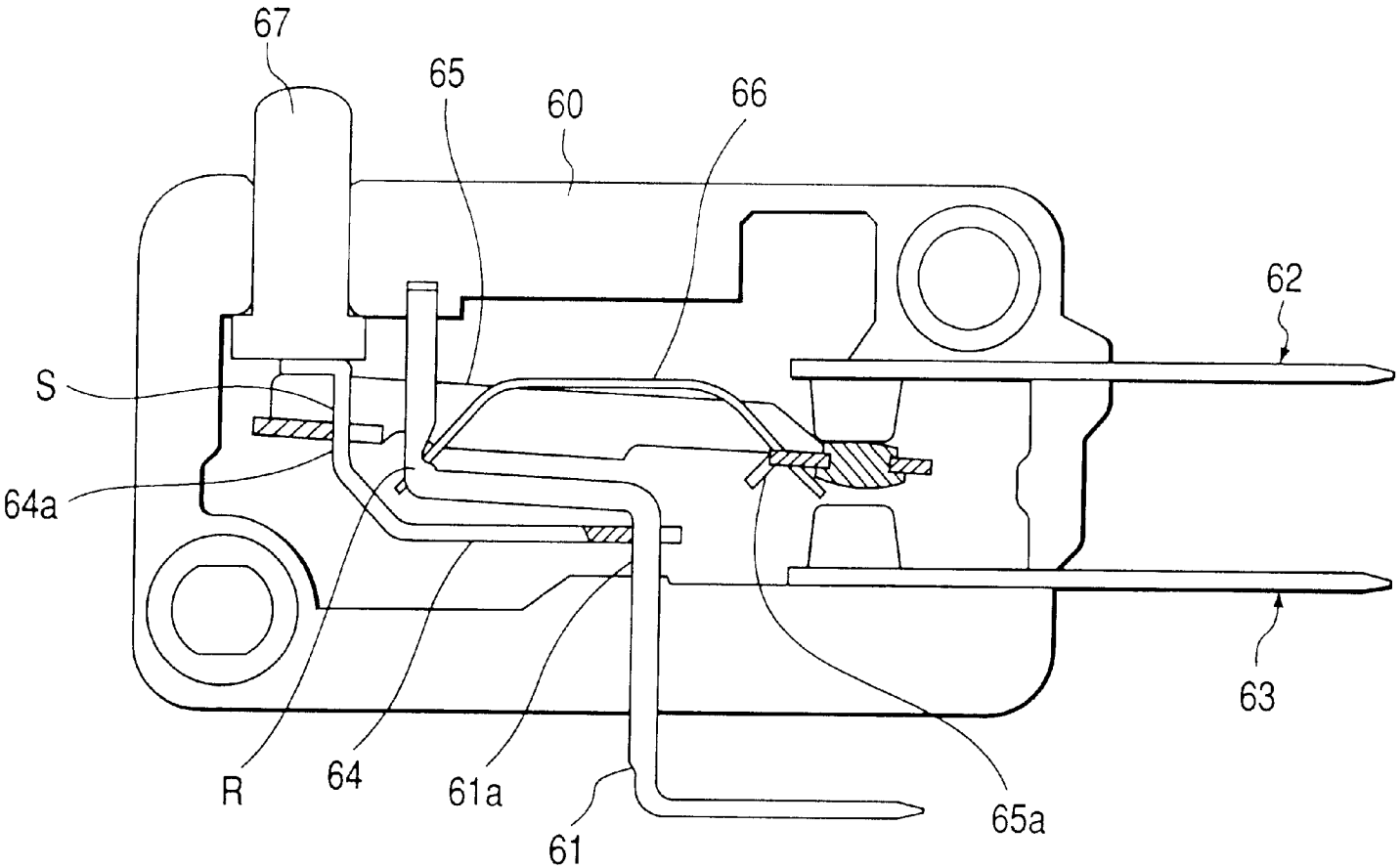
FIG. 24 is a front view showing an existing switching device while a cover is removed therefrom.

As shown in FIGS. 16 and 17, a movable spring 300 in accordance with the third embodiment is supported between the movable leaf 100 and the common terminal 200. One end of the movable spring 300 has a narrow width and is fitted into a cutout 171' formed in the movable leaf 100. A cutout is formed in the center of the other end of the movable spring 300, and an engagement groove 210' of the common terminal 200 is engaged with the cutout. FIGS. 22 and 23 show a movable spring in accordance with the third embodiment.

The layout of the components will now be described.

The fixing section 150 of the movable leaf 100 is inserted into the insert hole 230 formed in the common terminal 200. The protuberance 220 of the common terminal 200 is inserted into the hole 151 of the movable leaf 100. The movable leaf 100 is mechanically and electrically connected to the common terminal 200 by fixation of the protuberance 220 to the hole 151. The movable leaf 100 may be connected to the common terminal 200 by welding or screwing, as well as caulking.

An end 250 of the common terminal 200 is positioned in the clearance between an end section 135 of the S-shaped displacement absorbing section 130 and the constriction 161.

In this state, the movable spring 300 is sandwiched between the movable leaf 100 and the common terminal 200 and acts as a compression spring so as to separate them from each other.

The lever arms 120 of the movable leaf 100 has the spring characteristics and acts as a compression spring against the movable spring 300. the displacement absorbing section 130 has a flexible-shaped so that the movable leaf 100 can move freely in spite of the fixation of the movable leaf 100 and the common terminal 200.

The operation of the switching device will now be described.

As shown in FIGS. 16 and 17, in a state in which the actuation plunger 9 is not pressed, the movable leaf 100 is pushed in an upward direction, thereby holding the movable contact 40 provided on the movable leaf 100 in contact with the upper first fixed contact 22. In FIG. 17, Q' designates a contact point between the actuation plunger 9 and the movable leaf 100, and R' designates a contact point between the movable spring 300 and the common terminal 200.

As the actuation plunger 9 is depressed, the contact point Q' between the movable leaf 100 and the actuation plunger 9 is moved in a downward direction while the movable contact 40 is held in contact with the first fixed contact 22.

If the contact point Q' is moved in a downward direction further beyond a plane P' which includes the movable contact 40 and the contact point R' as a result of further depression of the actuation plunger 9, the movable contact 40 is brought into contact with the lower second fixed contact 24 by means of the snap action of the movable leaf 100. Although the movable contact 100 is fixed to the common terminal 200, the movable contact 100 can move freely by means of the displacement absorbing section 130, thereby performing the snap action.

In this third embodiment, although the side piece sections and the lever arm sections are fromed from one metal plate, the lever arm sections may be separately formed from the side piece sections.

The foregoing description of the preferred embodiments of the invention has been presented for the purpose of illustration and description only. It is not intended to be exhaustive or to limit the invention to the precise form disclosed, and modifications and variations are possible in light of and within the scope of the invention. The preferred embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and equivalents thereof.

What is claimed is:

1. A switching device for bringing a movable contact into and out of contact with a fixed contact by snap action, comprising:

a movable member comprising the movable contact;

means for moving the movable member by the snap action to bring the movable contact into and out of contact with the fixed contact;

a common terminal fixed to the movable member; and a movable spring member connected at one end to the common terminal and at the other end to the movable member, wherein the movable member further comprises a displacement absorber for absorbing the displacement of the movable member caused by the snap action of the moving means.

2. A switching device according to claim 1, wherein the movable member has spring characteristics.

3. A switching device for bringing a movable contact into and out of contact with a fixed contact by snap action, comprising:

a movable member comprising the movable contact;

means for moving the movable member by the snap action to bring the movable contact into and out of contact with the fixed contact;

a common terminal fixed to the movable member;

a lever provided in a rotatable manner; and a movable spring member connected at one end to a free end of the lever in a rotatable manner and at the other end to the movable member, wherein the movable member further comprises a displacement absorber for absorbing the displacement of the movable member caused by the snap action of the moving means, and wherein the snap action is performed when a point of connect between the movable spring member and the lever moves so as to cross a line which extends from the movable contact to a point where the movable member and the common terminal join.

4. A switching device according to claim 3, wherein the movable member comprises:

a fixing section formed in a surface portion of a terminal main body via the displacement absorber; and side piece sections formed in the terminal main body, and further wherein the fixing section is fixed to the common terminal and each of the side piece sections has engagement section formed at a front end thereof; the engagement section being pivotably supported by the common terminal.

5. A switching device according to claim 4, wherein the displacement absorber is formed from a zigzag-shaped strap which is connected at one end to the terminal main body of the movable member and is connected at the other end to the fixing section.

6. A switching device according to claim 4, wherein the displacement absorber is formed from a corrugated strap which is connected at one end to the terminal main body of the movable member and is connected at the other end to the fixing section.

7. A switching device for bringing a movable contact into and out of contact with a fixed contact by snap action, comprising:

a movable member comprising the movable contact;

means for moving the movable member by the snap action to bring the movable contact into and out of contact with the fixed contact;

a common terminal fixed to the movable member;

a movable spring member connected at one end to the common terminal and at the other end to the movable member; and a lever arm joined at one end portion of the movable member, wherein the movable member further comprises a displacement absorber for absorbing the displacement of the movable member caused by the snap action of the moving means, and wherein the snap action is performed when a point of connect between the movable member and the lever arm moves so as to cross a line which extends from the movable contact to a point where the movable spring member and the common terminal join.

8. A switching device for bringing a movable contact into and out of contact with a fixed contact by snap action, comprising:

a movable member comprising the movable contact;

means for moving the movable member by the snap action to bring the movable contact into and out of contact with the fixed contact;

a common terminal fixed to the movable member; and a movable spring member connected at one end to the common terminal and at the other end to the movable member, wherein the movable member further comprises a displacement absorber for absorbing the displacement of the movable member caused by the snap action of the moving means and a lever arm integrally formed at one end portion thereof, and wherein the snap action is performed when a point of connect between the movable member and the lever arm moves so as to cross a line which extends from the movable contact to a point where the movable spring member and the common terminal join.

9. A switching device for bringing a movable contact into and out of contact with a fixed contact by snap action, comprising:

a movable member comprising the movable contact;

means for moving the movable member by the snap action to bring the movable contact into and out of contact with the fixed contact;

a common terminal fixed to the movable member; and a movable spring member connected at one end to the common terminal and at the other end to the movable member, wherein the movable member further comprises a displacement absorber for absorbing the displacement of the movable member caused by the snap action of the moving means, and side piece sections and lever arms being integrally formed at same ends of the side piece sections, and wherein the snap action is performed when a point of connect between the side piece section and the lever arm moves so as to cross a line which extends from the movable contact to a point where the movable spring member and the common terminal join.

* * * * *